US006513426B2

(12) United States Patent
Orimoto

(10) Patent No.: US 6,513,426 B2
(45) Date of Patent: Feb. 4, 2003

(54) STENCIL PRINTING MACHINE

(75) Inventor: Masaki Orimoto, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/795,199

(22) Filed: Mar. 1, 2001

(65) Prior Publication Data

US 2002/0124740 A1 Sep. 12, 2002

(30) Foreign Application Priority Data

Mar. 1, 2000 (JP) ..... 2000-056116

(51) Int. Cl.[7] ..... B41L 13/00
(52) U.S. Cl. ..... 101/120; 101/116
(58) Field of Search ..... 101/116, 117, 101/118, 119, 120, 123, 124, 129; 118/406, 409

(56) References Cited

U.S. PATENT DOCUMENTS

| | | | | |
|---|---|---|---|---|
| 3,835,772 A | | 9/1974 | Springer | 101/116 |
| 4,628,813 A | * | 12/1986 | Hasegawa et al. | 101/116 |
| 5,251,566 A | * | 10/1993 | Kobayashi et al. | 101/116 |
| 6,186,062 B1 | * | 2/2001 | Ohno | 101/116 |
| 6,336,401 B1 | * | 1/2002 | Hasebe | 101/116 |

FOREIGN PATENT DOCUMENTS

| | | | |
|---|---|---|---|
| EP | 0 607 699 A1 | 7/1994 | B41L/13/06 |
| GB | 1 419 843 | 12/1975 | B41L/27/24 |
| GB | 2 272 668 A | 5/1994 | B41F/15/08 |
| GB | 2 275 227 A | 8/1994 | B41L/13/06 |

* cited by examiner

*Primary Examiner*—Ren Yan
(74) *Attorney, Agent, or Firm*—Sughrue Mion, PLLC

(57) ABSTRACT

Printing pressure to be applied to a press roller (18) is obtained by a pressure applying spring (33) and an adjustable spring (41), and the adjustable spring (41) is extended or contracted by a tensile-force varying mechanism, thereby rendering the printing pressure variable. Accordingly, in cases such as where the viscosity of ink has changed due to a temperature change, and the contact time of a printing sheet (P) with respect to a rotary cylindrical drum (14) or a stencil sheet (M) has changed due to a change in the printing speed, it is possible to stabilize printed image performance by adjusting the density of an image which is printed. In addition, a strong tensile force for stabilizing the printing pressure by the press roller (18) is dispersed between the pressure applying spring (33) and the adjustable spring (41), and the adjustable spring (41) is extended or contracted.

4 Claims, 5 Drawing Sheets

STENCIL PRINTING MACHINE

BACKGROUND OF THE INVENTION

1. Field of the Invention

The present invention relates to a stencil printing machine in which printing pressure is made variable to adjust the density during printing.

The present application is based on Japanese Patent Application No. 2000-056116, which is incorporated herein by reference.

2. Description of the Related Art

As shown in FIG. 5, a stencil printing machine generally has a porous rotary cylindrical drum 114 to an inner periphery of which ink is supplied and which is disposed in such a manner as to be rotatable about its own axis. A stencil sheet M subjected to a stencil making process is wrapped around an outer peripheral surface of the rotary cylindrical drum 114. Further, a press roller 118 is disposed on the lower side of the rotary cylindrical drum 114. As a printing sheet P is supplied in synchronism with the rotation of the rotary cylindrical drum 114, and the printing sheet P and the rotary cylindrical drum 114 are brought into pressure contact with each other by the press roller 118, ink is passed through perforated portions of the stencil sheet M from inside the rotary cylindrical drum 114, thereby effecting printing on the printing sheet P.

The press roller 118 is rotatably supported by a support member 130. The support member 130 is fixed to a support shaft 131 which is disposed rotatably. Further, the support shaft 131 fixes a press arm 132. This press arm 132 is pulled in a counterclockwise direction in FIG. 5 about the support shaft 131 by a tension spring 133. As a result, the press arm 132 rotates the support shaft 131, which in turn causes the support member 130 fixed to the support shaft 131 to rotate counterclockwise in FIG. 5, thereby causing the press roller 118 to move to a pressure contacting position at which the press roller 118 is pressed against the outer peripheral surface of the rotary cylindrical drum 114.

At this pressure contacting position, the press roller 118 is pressed against the outer peripheral surface of the rotary cylindrical drum 114 by the tensile force of the tension spring 133, and thereby obtains printing pressure for causing the printing sheet P to be brought into pressure contact with the outer peripheral surface of the stencil sheet M wrapped around the rotary cylindrical drum 114.

Further, the press arm 132 has a cam follower 135 capable of being brought into sliding contact with a cam 136, which rotates about the same axis as that of the rotary cylindrical drum 114, by the tensile force of the tension spring 133. As the cam 136 rotates, the support shaft 131 is rotated clockwise in FIG. 5. As a result, the press arm 132 rotates the support shaft 131, which in turn causes the support member 130 fixed to the support shaft 131 to rotate clockwise in FIG. 5, thereby moving the press roller 118 to move to a retreated position at which the press roller 118 is spaced apart from the outer peripheral surface of the rotary cylindrical drum 114.

With the above-described stencil printing machine, however, the density of a printed image changes in cases such as where the viscosity of the ink has changed due to a temperature change, and the contact time of the printing sheet P with respect to the rotary cylindrical drum 114 (stencil sheet M) has changed due to a change in the printing speed. To cope with this situation, it is conceivable to adjust the density by making variable the printing pressure by the press roller 118, i.e., the tensile force of the tension spring 133.

However, the tension spring 133 is so designed as to be able to obtain a strong tensile force in order to stabilize the printing pressure by the press roller 118. For this reason, to make the tensile force of the tension spring 133 variable, a large-size driving mechanism (a motor, a gear, etc.) having a strong driving force overcoming the tensile force of the tension spring 133 becomes necessary, so that there are problems in that the cost becomes high, and that the size of the machine becomes large.

SUMMARY OF THE INVENTION

Accordingly, an object of the present invention is to provide a stencil printing machine which is capable of making the printing pressure variable after realizing the low cost and compact size, and which is capable of stabilizing the printed image performance in correspondence with the printing speed and the ambient temperature, thereby overcoming the above-described problems.

To achieve the above object, according to a first aspect of the present invention, there is provided a stencil printing machine which comprises a rotary cylindrical drum rotatable about its own axis, the rotary cylindrical drum including an inner surface to which ink is supplied, and an outer peripheral surface around which a stencil sheet subjected to a stencil making process is wrapped, a press roller movable into contact with and away from the rotary cylindrical drum, wherein a printing sheet is transported in synchronism with a rotation of the rotary cylindrical drum, and is brought into pressure contact with an outer peripheral surface of the stencil sheet by the press roller so as to effect stencil printing with respect to the printing sheet, a plurality of tension springs capable of applying printing pressure for pressing the press roller against the outer peripheral surface of the rotary cylindrical drum, and a tensile-force varying mechanism capable of extending or contracting one of the plurality of tension springs so as to render the printing pressure variable.

In the stencil printing machine according to the first aspect of the present invention, even if the viscosity of ink has changed due to a temperature change, and the contact time of the printing sheet with respect to the rotary cylindrical drum (stencil sheet) has changed due to a change in the printing speed, the printed image performance can be stabilized by adjusting the density of the image because the printing pressure is variable. In addition, a strong tensile force for stabilizing the printing pressure by the press roller can be dispersed by using the plurality of tension springs, and hence one of the dispersed tension springs may be extended or contracted. Accordingly, it is possible to reduce the driving force for rendering the printing pressure variable. Therefore, it is possible to realize a compact driving mechanism (e.g., tensile-force varying mechanism as described above) and a reduction of the cost.

Further, according to a second aspect of the present invention, the tensile-force varying mechanism of the first aspect may include a worm wheel capable of extending or contracting one of the plurality of tension springs in accordance with a rotation of the worm wheel, a worm capable of meshing with the worm wheel, a speed reducing gear capable of meshing with the worm, and a drive device capable of rotatively driving the worm through the speed reducing gear. Consequently, it is possible to hold the extended or contracted state of the tension spring without rotating the worm wheel by pulling back by the tensile force of the tension spring. In addition, since the speed reducing gear is interposed between the worm and the drive device in the tensile-force varying mechanism, the load on the drive device is alleviated, so that the adoption of a more compact drive device can be realized, thereby making it possible to attain a reduction of the cost.

Further, according to a third aspect of the present invention, the stencil printing machine of the second aspect may further comprise a sensor detecting piece, formed on the worm wheel, and a sensor capable of detecting a position of the sensor detecting piece to recognize a rotated position of the worm wheel.

Furthermore, according to a fourth aspect of the present invention, the stencil printing machine of the first aspect may further comprise a sensor capable of detecting a motion of the tensile-force varying mechanism so as to recognize a state of extension or contraction of one of the plurality of tension springs.

DETAILED DESCRIPTION OF THE PREFERRED EMBODIMENT

A preferred embodiment of the present invention will be described hereinbelow with reference to the accompanying drawings.

Figure 1:
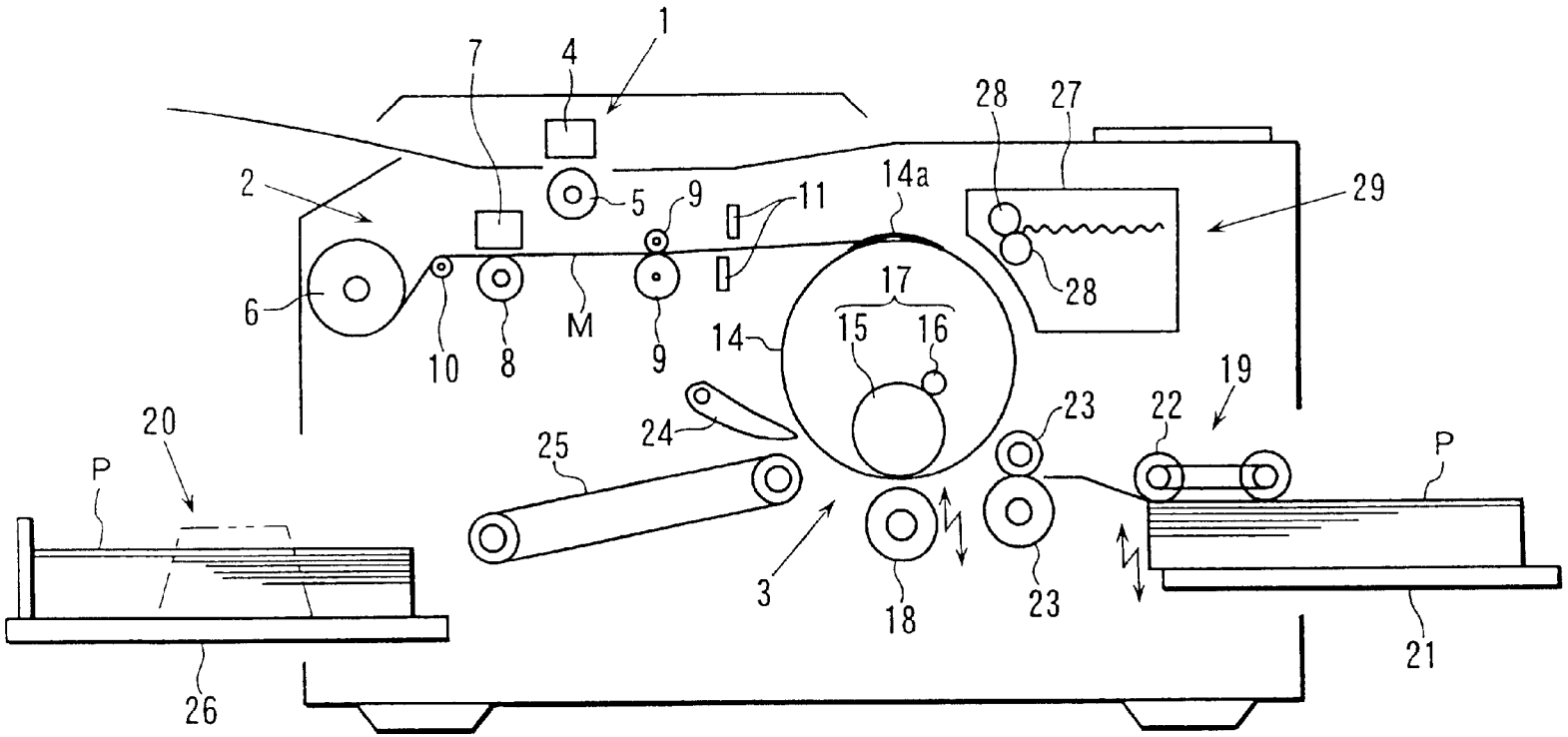
FIG. 1 is a side elevational view illustrating a example of a stencil printing machine in accordance with the present invention.

FIG. 1 is a side elevational view illustrating a stencil printing machine having a stencil-making function as an example of the stencil printing machine in accordance with the present invention.

This stencil printing machine has an original reading section 1, a stencil making section 2, and a printing section 3.

The original reading section 1 is an image scanner having a line image sensor 4 for effecting the reading of an image on an original which is transported in a vertical scanning direction and an original feeding roller 5. It should be noted that the original reading section 1 is not limited to the above-described configuration, and the image on the original may be read by moving the line image sensor 4 in the vertical scanning direction with respect to a fixed original. Namely, the original reading section 1 reads the image on the original by relatively moving the original and the line image sensor 4.

The stencil making section 2 includes a stencil roll portion 6, a thermal head 7 arranged in a horizontal row and formed of a plurality of dot-like heating elements, a platen roller 8, stencil feeding rollers 9, a stencil guide roller 10, and a stencil cutter 11. As the platen roller 8 rotates, a stencil sheet M is continuously drawn out from the stencil roll portion 6, and is transported between the thermal head 7 and the platen roller 8. Image data of the original which has been read by the aforementioned original reading section 1 is input to the thermal head 7. The plurality of dot-like heating elements of the thermal head 7 are individually and selectively heated, so that the thermographic stencil sheet M is subjected to a thermographic stencil-making process, to thereby form a desired perforated image formed of a plurality of fine through perforations in the stencil sheet M in a dot-matrix manner. During this stencil making process, as for the stencil sheet M drawn out from the stencil roll portion 6 by the platen roller 8, a desired tensile force is applied thereto by the stencil guide roller 10 to prevent the occurrence of creases and the like. In addition, the stencil sheet M, which has undergone the stencil making process, is further transported by the stencil feeding roller 9, and one stencil portion is cut by the stencil cutter 11.

The printing section 3 includes an ink-permeable rotary cylindrical drum 14 of a porous structure formed of an ink-permeable material such as a porous metal plate, a mesh structure, or the like; an ink supplying unit 17 having a squeegee roller 15 and a doctor roller 16 and disposed inside the rotary cylindrical drum 14; and a press roller 18. The rotary cylindrical drum 14 is rotatively driven in a clockwise direction in FIG. 1 about its own axis by a rotation drive device (not shown). Further, the rotary cylindrical drum 14 is provided with a clamp portion 14*a* for clamping an end portion of the stencil sheet M. As the rotary cylindrical drum 14 rotates while clamping a leading end portion of the transported stencil sheet M (already subjected to the stencil making process) by the clamp portion 14*a*, the stencil sheet M is wrapped and fitted around its outer peripheral surface.

In addition, a sheet supplying section 19 is disposed on one side of the printing section 3, and a sheet discharging is disposed on the other side thereof.

The sheet supplying section 19 has a sheet supplying tray 21 on which a printing sheet P is stacked; pickup rollers 22 for fetching the printing sheet P one sheet at a time from the sheet supplying tray 21; and sheet supplying-timing rollers 23 for feeding the printing sheet P into a nip between the rotary cylindrical drum 14 and the press roller 18.

The sheet discharging section 20 has a separating claw 24 for separating the printing sheet P from the rotary cylindrical drum 14; a discharged-sheet feeding-belt section 25; and a sheet discharging tray 26 on which the printed sheets of the printing sheet P are stacked.

Further, a stencil discharging section 29 including stencil discharging rollers 28 for peeling the used stencil sheet M from the rotary cylindrical drum 14 and delivering it into a stencil discharging box 27 is disposed on one side of the printing section 3.

In the stencil printing machine having the above-described construction, printing ink of a predetermined color is supplied to an inner peripheral surface of the rotary cylindrical drum 14 by the ink supplying unit 17. The rotary cylindrical drum 14 is rotatively driven in a clockwise direction in FIG. 1 about its own axis by a rotation drive device (not shown). The printing sheet P is fed into a nip between the rotary cylindrical drum 14 and the press roller 18 in a state of movement from right to left in FIG. 1 by the sheet supplying-timing rollers 23 at a predetermined timing in synchronism with the rotation of the rotary cylindrical drum 14. Then, as the printing sheet P is brought into pressure contact with the stencil sheet M wrapped around the outer peripheral surface of the rotary cylindrical drum 14 by the movement of the press roller 18, the ink which passed through the stencil sheet M is transferred onto the printing sheet P from the rotary cylindrical drum 14, thereby effecting stencil printing.

A description will be given below of a driving unit for moving the press roller 18 in the stencil printing machine having the above-described construction.

Figure 2:
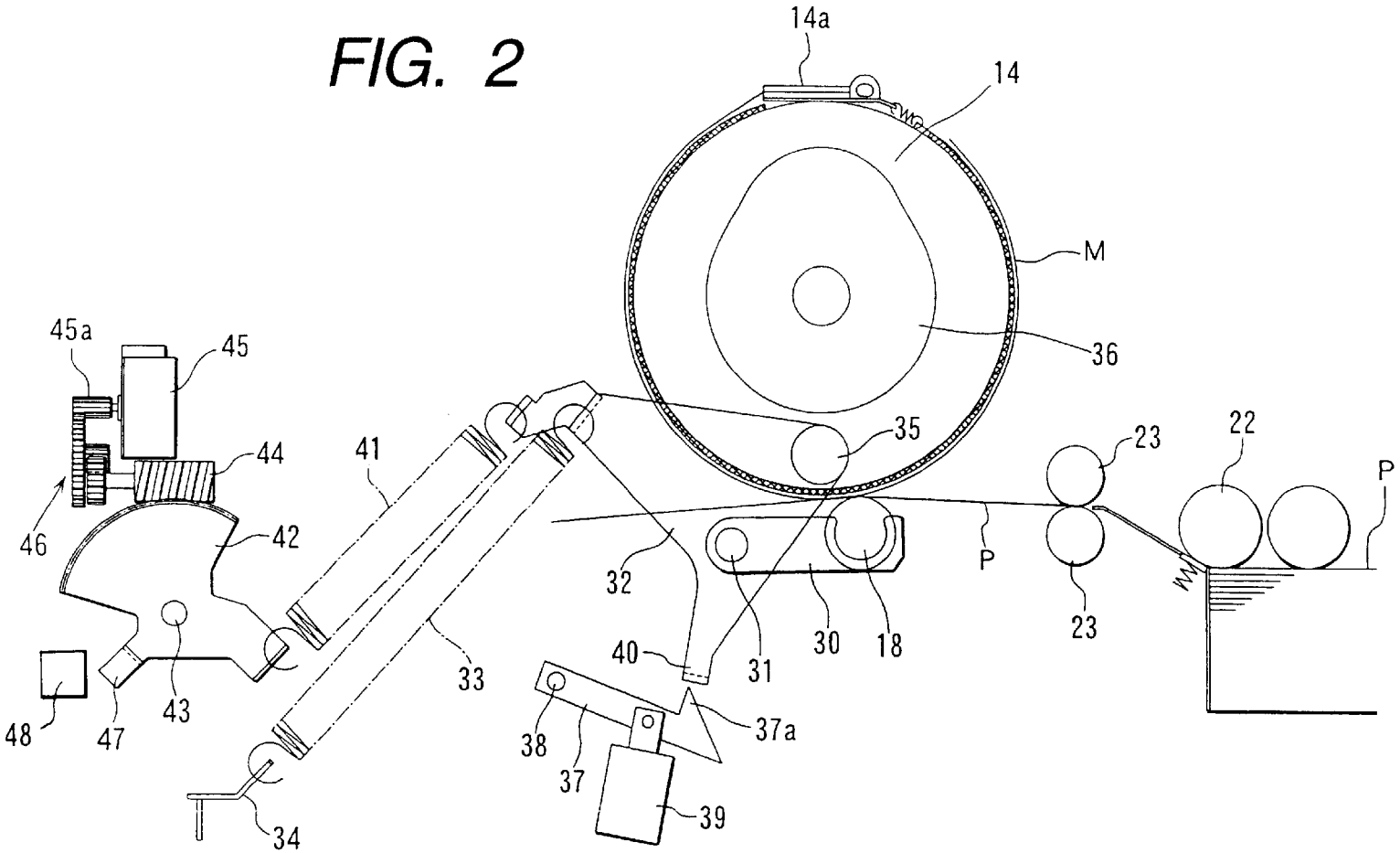
FIG. 2 is a side elevational view illustrating a driving unit and a printing-pressure varying unit for a press roller.

FIG. 2 is a side elevational view illustrating a driving unit for driving the press roller.

As shown in FIG. 2, the press roller 18 extends in the axial direction of the rotary cylindrical drum 14, and is supported by a support member 30 in such a manner as to be rotatable about its own axis. The support member 30 is fixed to a support shaft 31 which is rotatably supported by a frame (not shown) of the stencil printing machine which is a fixed side member. As a result, the press roller 18 is swingably displaceable about the support shaft 31 substantially in the vertical direction in FIG. 2, and is thus movable between a retreated position in which the press roller 18 is spaced apart from the outer peripheral surface of the rotary cylindrical drum 14 and a pressure contacting position at which it is pressed against the outer peripheral surface of the rotary cylindrical drum 14.

A press arm 32 is fixed to the support shaft 31. Therefore, the support member 30 for supporting the press roller 18 and the press arm 32 respectively swing about the support shaft 31.

One end of a pressure applying spring 33, which can serve as a tension spring, is fixed to the press arm 32. Further, the other end of the pressure applying spring 33 is fixed to a fixing member 34 disposed on the frame (not shown) of the stencil printing machine. As a result, the press arm 32 rotates the support shaft 31 in the counterclockwise direction in FIG. 2 by the tensile force of the pressure applying spring 33. This rotation of the support shaft 31 causes the support member 30 to swing in the counterclockwise direction in FIG. 2, thereby moving the press roller 18 to the pressure contacting position. Further, the tensile force of the pressure applying spring 33 serves as printing pressure for pressing the press roller 18 against the outer peripheral surface of the rotary cylindrical drum 14.

Further, the press arm 32 has a cam follower 35. This cam follower 35 is capable of being brought into sliding contact with a cam 36 which rotates about the same axis as that of the rotary cylindrical drum 14 in conjunction with the rotation of the rotary cylindrical drum 14.

Figure 3:
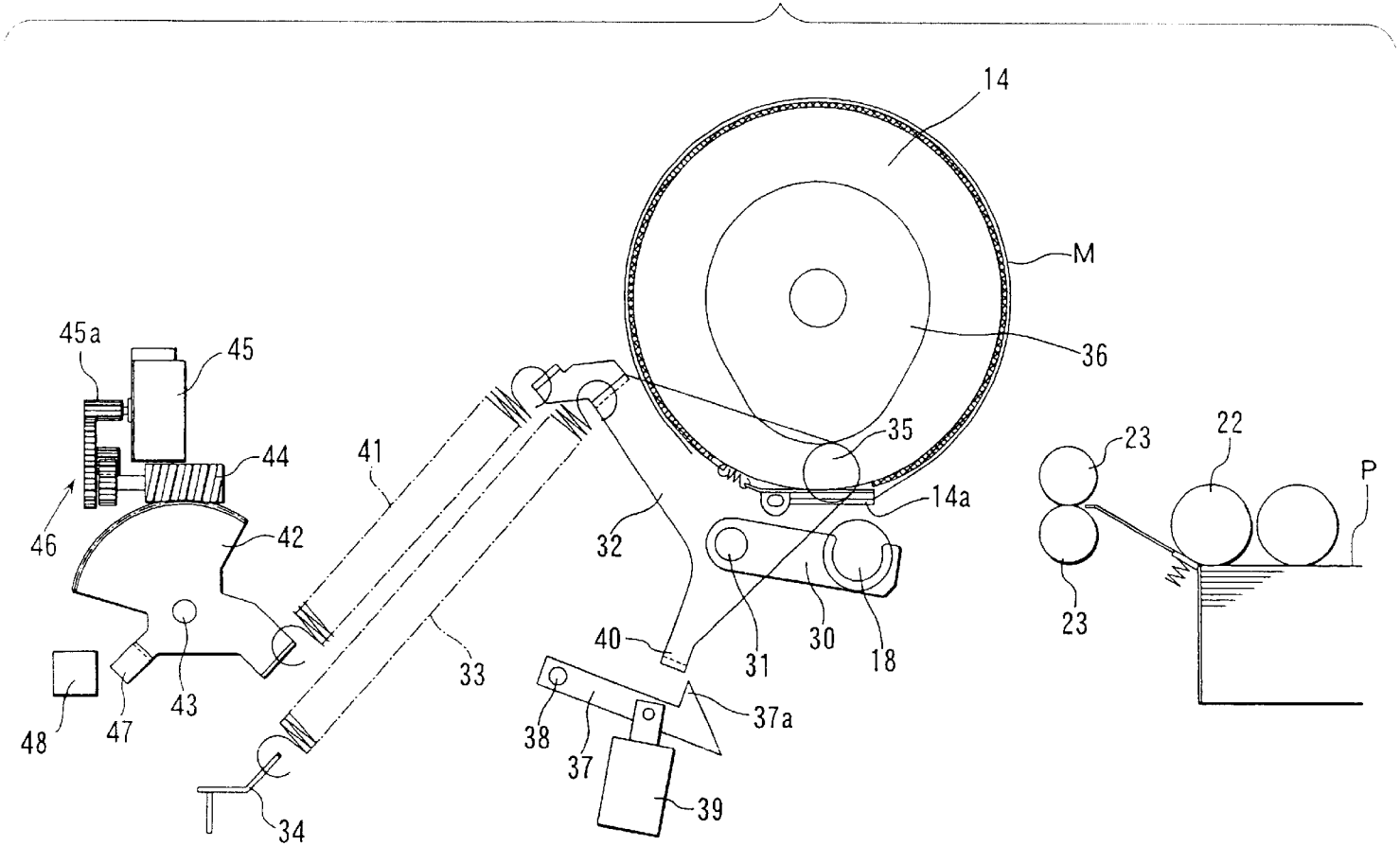
FIG. 3 is a diagram of the operation of the driving unit.

The sliding contact of the cam follower 35 with respect to the cam 36 is effected at a predetermined timing during normal printing. Specifically, as shown in FIG. 2, when the printing sheet P is brought into pressure contact with the outer peripheral surface of the rotary cylindrical drum 14 (stencil sheet M) by the press roller 18, the cam follower 35 is not brought into contact with the cam 36. Consequently, the tensile force (printing pressure) of the pressure applying spring 33 is transmitted to the press roller 18 without a loss. Then, as shown in FIG. 3, when the clamp portion 14*a* provided on the rotary cylindrical drum 14 is brought into contact with the press roller 18 by the rotation of the rotary cylindrical drum 14, the cam follower 35 is brought into contact with the cam 36. Consequently, the press arm 32 rotates the support shaft 31 in the clockwise direction, as shown in FIG. 3. This rotation of the support shaft 31 causes the support member 30 to swing in the clockwise direction in FIG. 3, thereby moving the press roller 18 to the retreated position.

Figure 4:
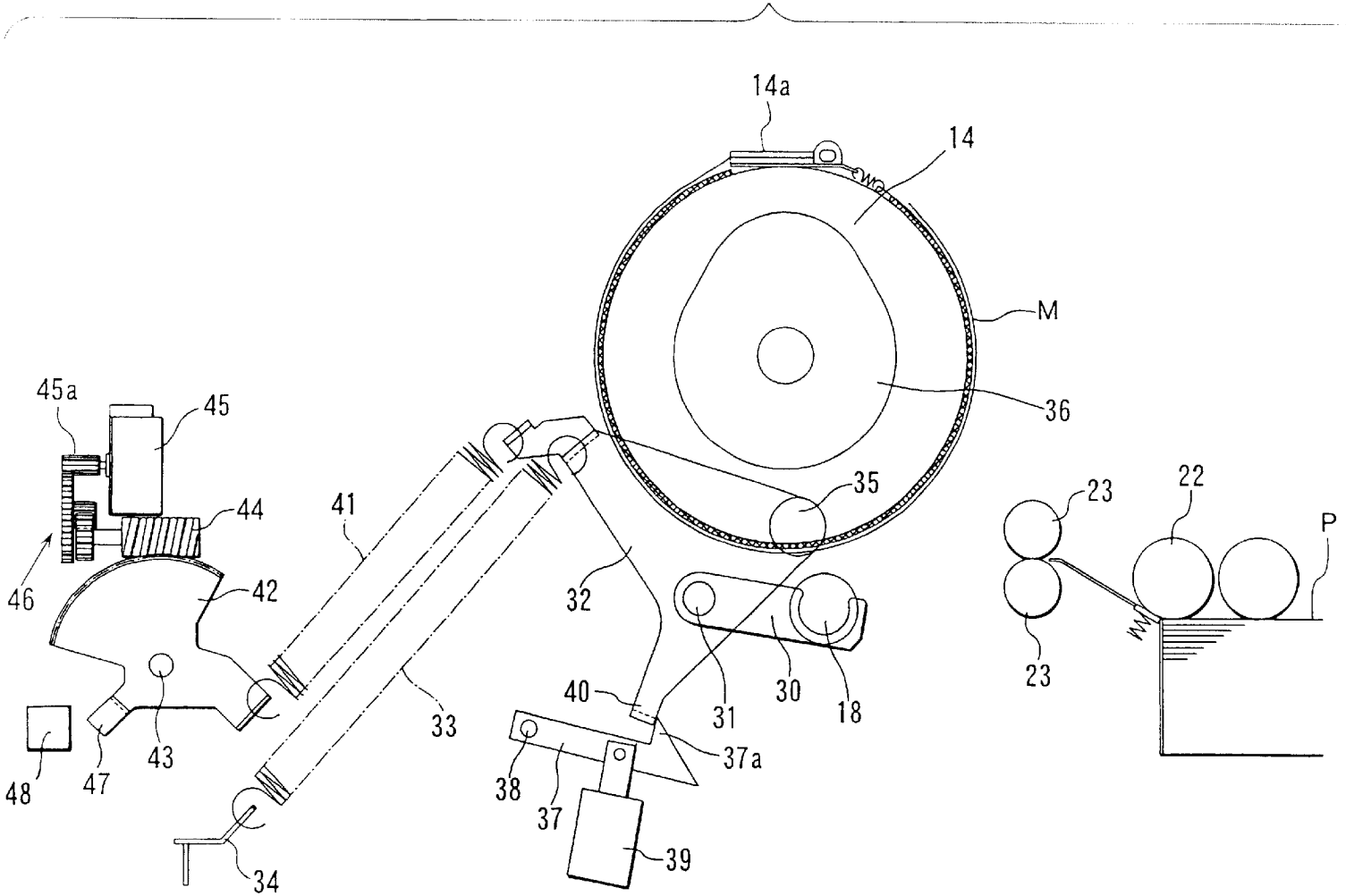
FIG. 4 is a diagram of the operation of the driving unit.
Figure 5:
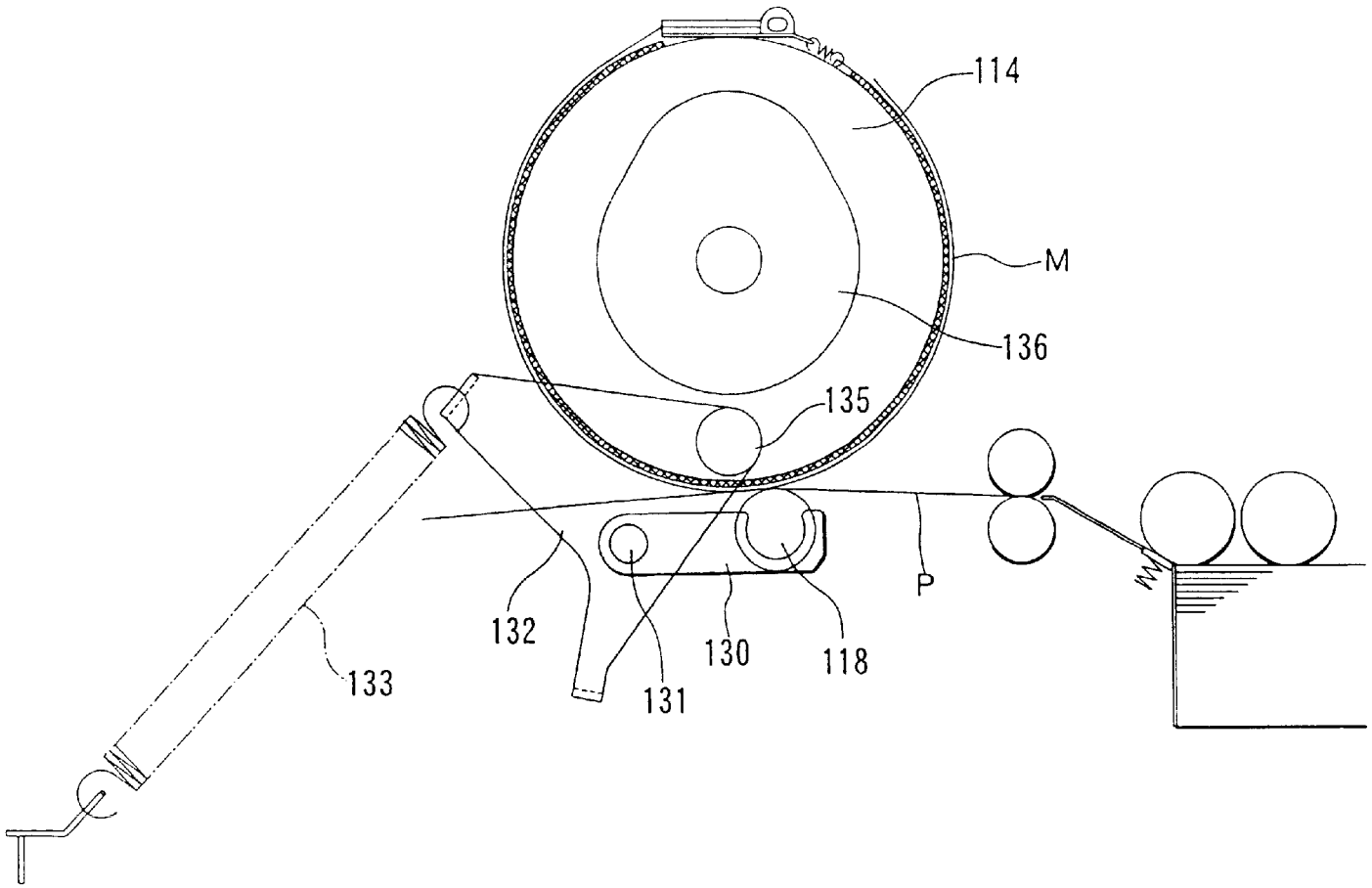
FIG. 5 is a side elevational view illustrating a driving unit for driving a press roller in the related art.

In addition, as shown in FIG. 2, on the lower side of the press arm 32, a press lever 37 is provided on the frame (not shown) of the stencil printing machine, which is a fixed side member, in such a manner as to be swingable on a shaft 38. Further, the press lever 37 is so arranged that a retaining pawl 37*a* which is at its swinging end is moved vertically by a solenoid 39. During the aforementioned period of normal printing (see FIGS. 2 and 3), the solenoid 39 keeps the retaining pawl 37*a* moved downward. During a period of non-printing shown in FIG. 4, the solenoid 39 keeps the retaining pawl 37*a* moved upward and retained at a retaining portion 40 formed on the lower side of the press arm 32. As a result, the press roller 18 is held in the retreated position irrespective of the rotation of the rotary cylindrical drum 14.

Thus, during printing, the driving unit moves the press roller 18 to the pressure contacting position at which the press roller 18 is brought into pressure contact with the outer peripheral surface of the rotary cylindrical drum 14 (stencil sheet M), and imparts printing pressure to the press roller 18 by means of the pressure applying spring 33. In addition, the driving unit moves the press roller 18 to the retreated position at which the press roller 18 is retreated from the outer peripheral surface of the rotary cylindrical drum 14 at a predetermined timing. Further, the driving unit holds the press roller 18 in the retreated position during non-printing.

A description will be given below of a printing-pressure varying unit for rendering variable the printing pressure applied to the press roller 18 in the stencil printing machine having the above-described construction.

As shown in FIG. 2, one end of an adjustable spring 41, which can serve as a tension spring, is fixed to the press arm 32. Further, the other end of the adjustable spring 41 is fixed to a driven gear 42. Consequently, the adjustable spring 41 is disposed substantially parallel to the pressure applying spring 33.

The driven gear 42 is attached to the frame (not shown) of the stencil printing machine, which is the fixed side member, in such a manner as to be rotatable by a rotary shaft 43, and meshes with a drive gear 44. Further, the driven gear 42 can serve as a worm wheel, and the drive gear 44 can serve as a worm. Therefore, since the driven gear 42 and the drive gear 44 mesh with each other, the adjustable spring 41 generates a tensile force between the press arm 32 and the driven gear 42, and this tensile force acts as the printing pressure for pressing the press roller 18 against the outer peripheral surface of the rotary cylindrical drum 14 together with the pressure applying spring 33.

The drive gear 44 meshes with a gear 45*a* located at an output shaft of a drive motor 45 through a speed reducing gear 46. As a result, the driving force of the drive motor 45 is transmitted to the drive gear 44 after its speed is reduced by the speed reducing gear 46, thereby rotating the driven gear 42. Then, the rotation of the driven gear 42 extends or contracts the adjustable spring 41 to render its tensile force variable.

Namely, as the adjustable spring 41 is extended, the tensile force of the adjustable spring 41 becomes large, so that the printing pressure which is applied to the press roller 18 together with the pressure applying spring 33 is made large. On the other hand, as the adjustable spring 41 is contracted, the tensile force of the adjustable spring 41 becomes small, so that the printing pressure which is applied to the press roller 18 together with the pressure applying spring 33 is made small.

Thus, a tensile-force varying mechanism is mainly comprised of a worm wheel (e.g., the driven gear 42 as described above), a worm (e.g., the drive gear 44 as described above), the speed reducing gear 46, and the drive motor 45, so as to render tensile force of the adjustable spring 41 variable by extending or contracting the adjustable spring 41. Moreover, the printing-pressure varying unit is mainly comprised of the tensile-force varying mechanism and the adjustable spring 41, so as to render variable the printing pressure for pressing the press roller 18 against the outer peripheral surface of the rotary cylindrical drum 14.

It should be noted that the driven gear 42 shown in FIG. 2 is formed in a fan shape in which a gear portion for extending or contracting the adjustable spring 41 is arranged substantially as a one-fourth rotation portion, and the other end of the adjustable spring 41 is fixed to a portion other than the gear portion, as described above.

In addition, a sensor detecting piece 47 is formed on a portion other than the gear portion of the driven gear 42. The position of the sensor detecting piece 47 is detected by a sensor 48 so that the rotated position of the driven gear 42 can be recognized. Thus, since it is possible to recognize the rotated position of the driven gear 42, the state of extension or contraction of the adjustable spring 41 can be recognized. For example, the sensor 48 may be an optical sensor but, it should not be limited thereto and thereby.

Accordingly, with the above-described stencil printing machine, as the printing-pressure varying unit, the printing pressure to be applied to the press roller 18 is obtained by the plurality of tension springs (e.g., the pressure applying spring 33 and the adjustable spring 41 as described above), and one of the tension springs (e.g., the adjustable spring 41 as described above) is extended or contracted by the tensile-force varying mechanism, thereby rendering the printing pressure variable. Consequently, in cases such as where the viscosity of the ink has changed due to a temperature change, and the contact time of the printing sheet P with respect to the rotary cylindrical drum 14 (stencil sheet M) has changed due to a change in the printing speed, it is possible to stabilize the printed image performance by adjusting the density of the image which is printed.

In addition, the strong tensile force for stabilizing the printing pressure by the press roller 18 is dispersed by using the plurality of tension springs (e.g., the pressure applying spring 33 and the adjustable spring 41 as described above), and one of them (e.g., the adjustable spring 41 as described above) is extended or contracted. As a result, it is possible to reduce the driving force for rendering the printing pressure variable, so that it is possible to realize a compact driving mechanism (e.g., the tensile-force varying mechanism as described above) and a reduction of the cost.

In addition, the driven gear 42 serving as a worm wheel, and the drive gear 44 serving as a worm, are adopted as the tensile-force varying mechanism for extending or contracting the adjustable spring 41. Consequently, it is possible to hold the extended or contracted state of the adjustable spring 41 without rotating the driven gear 42 by pulling back by the tensile force of the adjustable spring 41.

In addition, the speed reducing gear 46 is interposed between the drive gear 44 and the gear 45*a* of the output shaft of the drive motor 45 in the tensile-force varying mechanism for extending or contracting the adjustable spring 41. As a result, the load on the drive motor is alleviated, so that the adoption of a more compact drive motor can be realized, thereby making it possible to attain a reduction of the cost.

As described above, in the stencil printing machine according to the present invention, printing pressure to be applied to the press roller is obtained by the plurality of tension springs, and one of the tension springs is extended or contracted by the tensile-force varying mechanism, thereby rendering the printing pressure variable. Consequently, in cases such as where the viscosity of ink has changed due to a temperature change, and the contact time of the printing sheet with respect to the rotary cylindrical drum (stencil sheet) has changed due to a change in the printing speed, it is possible to stabilize the printed image performance because of the variable printing pressure by adjusting the density of the image which is printed on the printing sheet.

In addition, the strong tensile force for stabilizing the printing pressure by the press roller is dispersed by using the plurality of tension springs, and one of the dispersed tension springs is extended or contracted. As a result, it is possible to reduce the driving force for rendering the printing pressure variable, so that it is possible to realize a compact driving mechanism (e.g., tensile-force varying mechanism as described above) and a reduction of the cost.

In addition, in the stencil printing machine according to the present invention, a worm wheel and a worm are adopted as the tensile-force varying mechanism. Consequently, it is possible to hold the extended or contracted state of the tension spring without rotating the driven gear by pulling back by the tensile force of the tension spring.

In addition, the speed reducing gear is interposed between the worm and the drive motor in the tensile-force varying mechanism for extending or contracting the tension spring. As a result, the load on the drive motor is alleviated, so that the adoption of a more compact drive motor can be realized, thereby making it possible to attain a reduction of the cost.

What is claimed is:

1. A stencil printing machine, comprising:

a rotary cylindrical drum rotatable about its own axis, the rotary cylindrical drum including an inner surface to which ink is supplied, and an outer peripheral surface around which a stencil sheet subjected to a stencil making process is wrapped;

a press roller movable into contact with and away from the rotary cylindrical drum, wherein a printing sheet is transported in synchronism with a rotation of the rotary cylindrical drum, and is brought into pressure contact with an outer peripheral surface of the stencil sheet by the press roller so as to effect stencil printing with respect to the printing sheet;

a plurality of tension springs capable of applying printing pressure for pressing the press roller against the outer peripheral surface of the rotary cylindrical drum; and a tensile-force varying mechanism capable of continuously extending or contracting one of the plurality of tension springs so as to render the printing pressure variable.

2. A stencil printing machine, comprising:

a rotary cylindrical drum rotatable about its own axis, the rotary cylindrical drum including an inner surface to which ink is supplied, and an outer peripheral surface around which a stencil sheet subjected to a stencil making process is wrapped;

a press roller movable into contact with and away from the rotary cylindrical drum, wherein a printing sheet is transported in synchronism with a rotation of the rotary cylindrical drum, and is brought into pressure contact with an outer peripheral surface of the stencil sheet by the press roller so as to effect stencil printing with respect to the printing sheet;

a plurality of tension springs capable of applying printing pressure for pressing the press roller against the outer peripheral surface of the rotary cylindrical drum; and a tensile-force varying mechanism capable of extending or contracting one of the plurality of tension springs so as to render the printing pressure variable, wherein the tensile-force varying mechanism comprises:

a worm wheel capable of extending or contracting one of the plurality of tension springs in accordance with a rotation of the worm wheel, a worm capable of meshing with the worm wheel, a speed reducing gear capable of meshing with the worm, and a drive device capable of rotatively driving the worm through the speed reducing gear.

3. The stencil printing machine of claim 2, further comprising:

a sensor detecting piece, formed on the worm wheel; and a sensor capable of detecting a position of the sensor detecting piece to recognize a rotated position of the worm wheel.

4. A stencil printing machine, comprising:

a rotary cylindrical drum rotatable about its own axis, the rotary cylindrical drum including an inner surface to which ink is supplied, and an outer peripheral surface around which a stencil sheet subjected to a stencil making process is wrapped;

a press roller movable into contact with and away from the rotary cylindrical drum, wherein a printing sheet is transported in synchronism with a rotation of the rotary cylindrical drum, and is brought into pressure contact with an outer peripheral surface of the stencil sheet by the press roller so as to effect stencil printing with respect to the printing sheet;

a plurality of tension springs capable of applying printing pressure for pressing the press roller against the outer peripheral surface of the rotary cylindrical drum; and a tensile-force varying mechanism capable of extending or contracting one of the plurality of tension springs so as to render the printing pressure variable, further comprising a sensor capable of detecting a motion of the tensile-force varying mechanism so as to recognize a state of extension of contraction of one of the plurality of tension springs.

* * * * *